US007688281B2

(12) United States Patent
Watanabe

(10) Patent No.: US 7,688,281 B2
(45) Date of Patent: Mar. 30, 2010

(54) INFORMATION PROCESSING DEVICE AND CONTROL METHOD FOR INFORMATION PROCESSING DEVICE

(75) Inventor: Jun Watanabe, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1020 days.

(21) Appl. No.: 11/404,615

(22) Filed: Apr. 14, 2006

(65) Prior Publication Data

US 2007/0097048 A1 May 3, 2007

(30) Foreign Application Priority Data

Oct. 31, 2005 (JP) ..... 2005-317692

(51) Int. Cl.
*G09G 3/00* (2006.01)

(52) U.S. Cl. ..... 345/32; 345/87; 345/102

(58) Field of Classification Search ..... 345/32, 345/102

See application file for complete search history.

(56) References Cited

U.S. PATENT DOCUMENTS 5,854,617 A * 12/1998 Lee et al. ..... 345/102
5,870,158 A 2/1999 Abe et al.
2002/0158957 A1* 10/2002 Sung et al. ..... 347/178
2003/0007227 A1 1/2003 Ogino
2005/0017946 A1* 1/2005 Park ..... 345/156
2006/0044290 A1* 3/2006 Hurwitz et al. ..... 345/204

FOREIGN PATENT DOCUMENTS

JP 2004-062094 2/2004
JP 2004-133334 4/2004

OTHER PUBLICATIONS

Office Action dated May 16, 2008 in the Chinese Counterpart application together with English translation.

* cited by examiner

*Primary Examiner*—Richard Hjerpe
*Assistant Examiner*—Saifeldin Elnafia
(74) *Attorney, Agent, or Firm*—Blakely Sokoloff Taylor & Zafman, LLP

(57) ABSTRACT

According to one embodiment, an information processing device adapted to use in a first mode and a second mode includes a body, a display unit supported by the body, a display panel disposed at the display unit, a viewing angle control filter disposed at the display unit and arranged facing one face of the display panel, and drive unit configured to drive the control filter when a state of the processing device is in the second mode.

18 Claims, 8 Drawing Sheets

INFORMATION PROCESSING DEVICE AND CONTROL METHOD FOR INFORMATION PROCESSING DEVICE

CROSS-REFERENCE TO RELATED APPLICATIONS

This application is based upon and claims the benefit of priority from the prior Japanese Patent Application No. 2005-317692, filed Oct. 31, 2005, the entire contents of which are incorporated herein by reference.

BACKGROUND

1. Field

Embodiments of the present invention relate to an information processing device and a method for controlling a viewing angle.

2. Description of the Related Art

In recent years, liquid crystal display devices have been widely used as display devices for notebook type computers, monitors or the like. Improvements in viewing angle dependency of the liquid crystal display device has progressed and the viewing angle with the same level as that of a CRT has been achieved for the liquid crystal display device.

However, it is important for a display device, for the use of a mobile terminal, etc., to allow a user to view displayed items from the front direction and to make the display device hard to be viewed from the oblique direction. This is because, when confidential documents or the like are prepared or read in a public place and the like, the display device intends to prevent persons other than the user from viewing displayed documents or the like. Hence, the display device is structured to allow the user located in front of the display device to read or write a personal mail without caring about the surroundings.

As for a technique to control the viewing angle, a technique using a liquid crystal panel (hereinafter, referred to as a viewing angle control filter) is disclosed (refer to Jpn. Pat. Appln. KOKAI Publication No. 2004-133334). In the technique described in the aforementioned patent document, when the control filter is turned on, a blocking pattern is viewed from the obliquely front direction to protect information on a screen such as a text. Further, even when the control filter is operated, the manner of viewing from the front is not changed. When the control filter is turned off, the user can view the screen with an original viewing angle of an image display panel for displaying images.

DETAILED DESCRIPTION

Hereinafter, embodiments of the present invention will be described with reference to the drawings.

Figure 1:
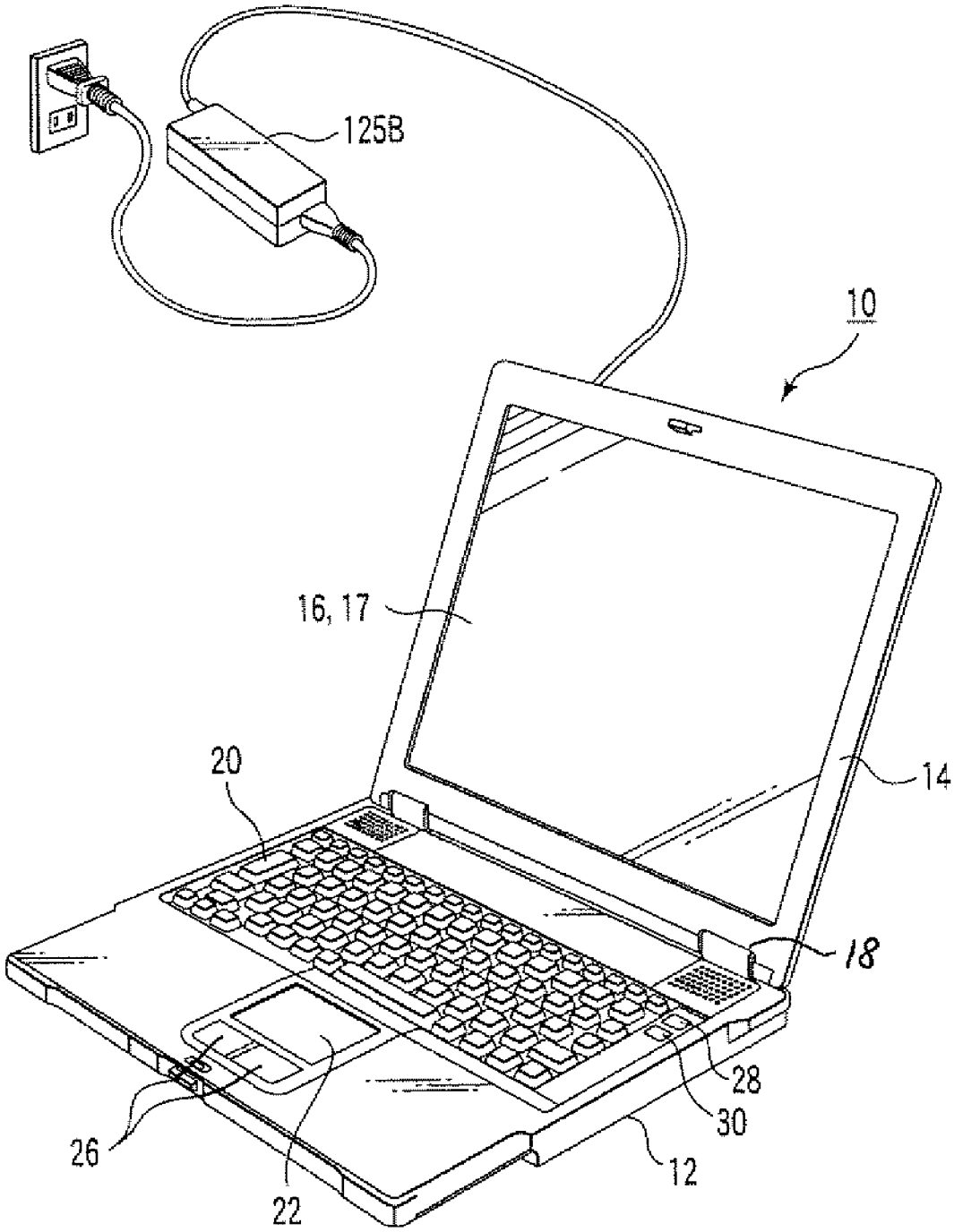
FIG. 1 is an exemplary perspective view showing an example of a schematic configuration of a personal computer as an information processing device regarding a first embodiment of the present invention.

FIG. 1 is an exemplary view showing an example of a notebook type personal computer as an information processing device regarding a first embodiment of the present invention.

A personal computer 10 comprises a computer main body 12 and a display unit 14. An LCD 16 being a display panel and a privacy filter (viewing angle control filter) 17 are incorporated in the display unit 14.

Figure 2:
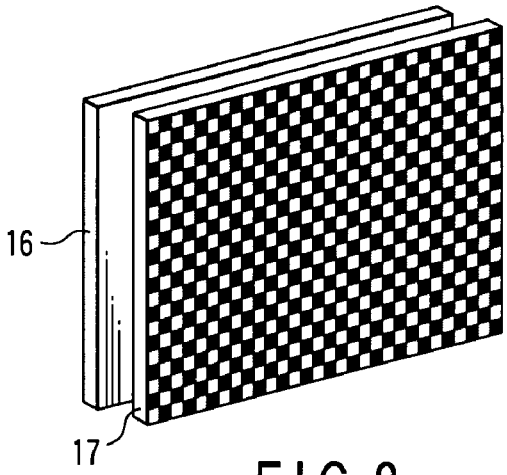
FIG. 2 is an exemplary view showing an example of an arrangement relationship between a liquid crystal display (LCD) and a privacy filter regarding the first embodiment.

The privacy filter 17 is, as shown in FIG. 2, mounted on an image display surface of the LCD 16. The privacy filter 17 may be mounted on a surface on an opposite side of the image display surface of the LCD 16. The personal computer 10 can use the privacy filter 17 by mounting it on a display device having a polarizer, such as an organic EL panel, a liquid crystal panel and others.

The display unit 14 as a display unit is attached to a hinge (support unit) 18 disposed at an end on a depth side of the main body 12 so as to vary rotatably between a closing position to cover an upper face of the main body 12 and an opening position to expose the upper face of the main body 12.

The main body 12 has a thin box-shaped housing, and a central part of an upper face of the housing is provided with a keyboard 20. A palm rest is formed on an upper face of a housing part on a near side of the main body 12. An almost central part of the palm rest is provided with a touch pad 22, a scroll button 24 and a touch pad control button 26. A power button 28 and a privacy filter button 30 to turn on/off a power of the main body 12 are arranged on the upper face of the housing part on the depth side of the main body 12.

The personal computer 10 is driven by a power supplied from an AC adapter 125B or by a battery disposed in the main body 12.

Figure 3A:
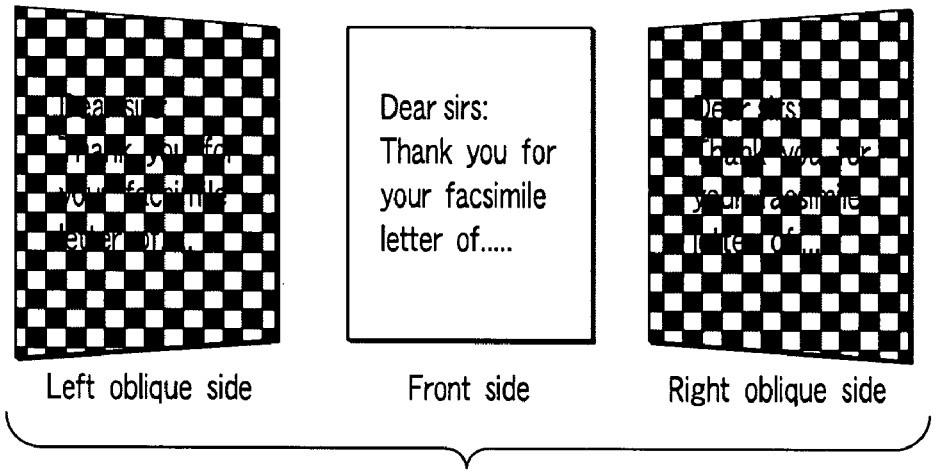
FIG. 3A and FIG. 3B are exemplary views explaining examples of viewing angle control by the privacy filters, respectively.
Figure 3B:
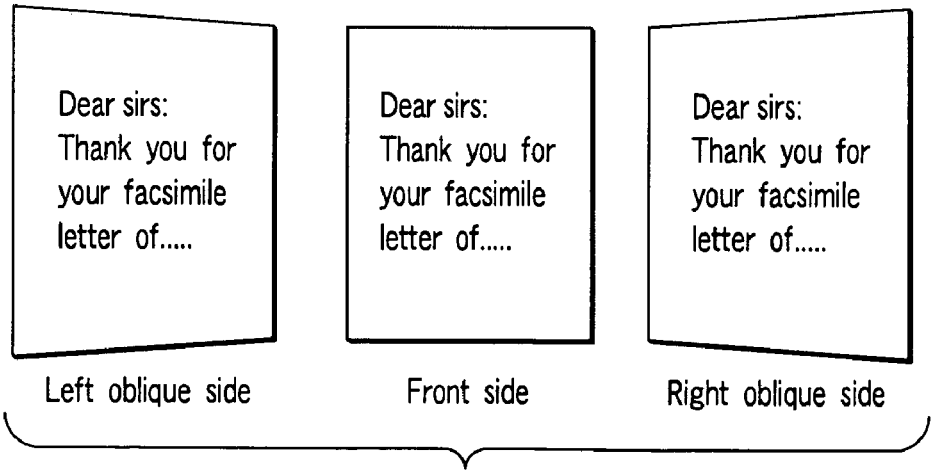

FIG. 3A and FIG. 3B show exemplary screen viewing angles when the privacy filters 17 are mounted on the LCDs 16, respectively. Three screens at an upper stage in FIG. 3A show states when voltage is applied to the privacy filter 17, in contrast, three screens at lower stage in FIG. 3B show states when no voltage is applied to the privacy filter 17. And in FIG. 3A and FIG. 3B, the left screens indicate screens viewed from left oblique side, the central screens indicate screens viewed from front side, and the right screens indicate screens viewed from right oblique side, respectively.

As mentioned above, in a state where no voltage is applied as shown in FIG. 3B, the personal computer 10 displays the same screen as that displayed even when the screen is viewed from the left or right oblique side.

In contrast, in a state where voltage is applied as shown in FIG. 3A, the personal computer 10 produces the same screen as that displayed when the screen is viewed from the front direction. However, when the screen is viewed from the left or right oblique side, a blacken part is generated in response to an area disposed on an orientation film to block the display on an LCD device. By displaying such a block figure, the personal computer 10 makes recognition of the screen from an obliquely lateral direction more difficult and can prevent other persons from reading material displayed on the screen.

Figure 4:
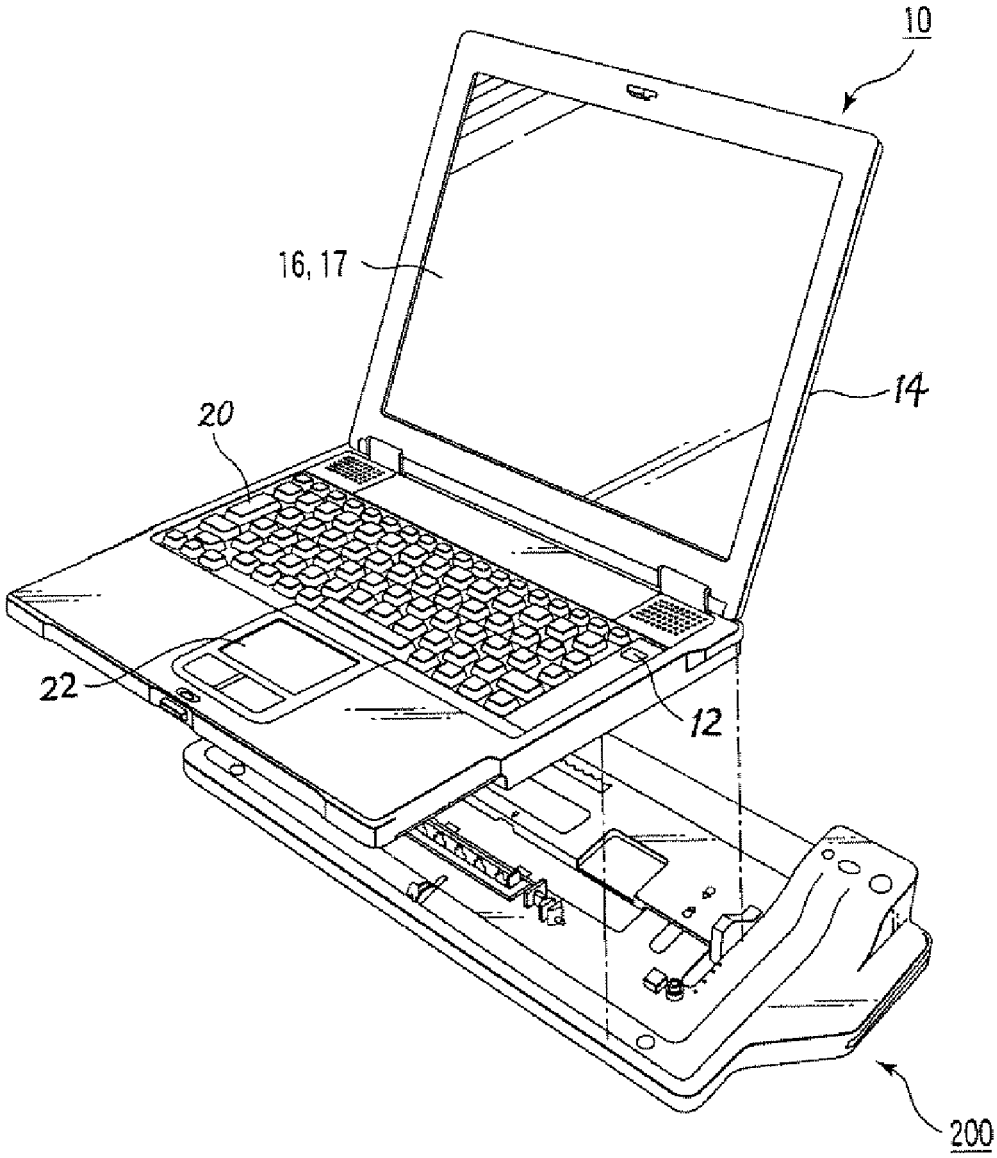
FIG. 4 is an exemplary perspective view showing an example of a schematic configuration of the personal computer as the processing device regarding the first embodiment of the present invention and a docking station as an expansion unit.

The information processing device, as shown in FIG. 4, can connect a docking station 200 as an expansion unit to a bottom face of the main body 12. The docking station 200 has a PS/2 connector, a universal serial bus (USB) connector, a digital visual interface (DVI) connector, a parallel connector and a LAN connector.

Next, an example of a system configuration of the personal computer 10 will be described by referring to FIG. 5.

Figure 5:
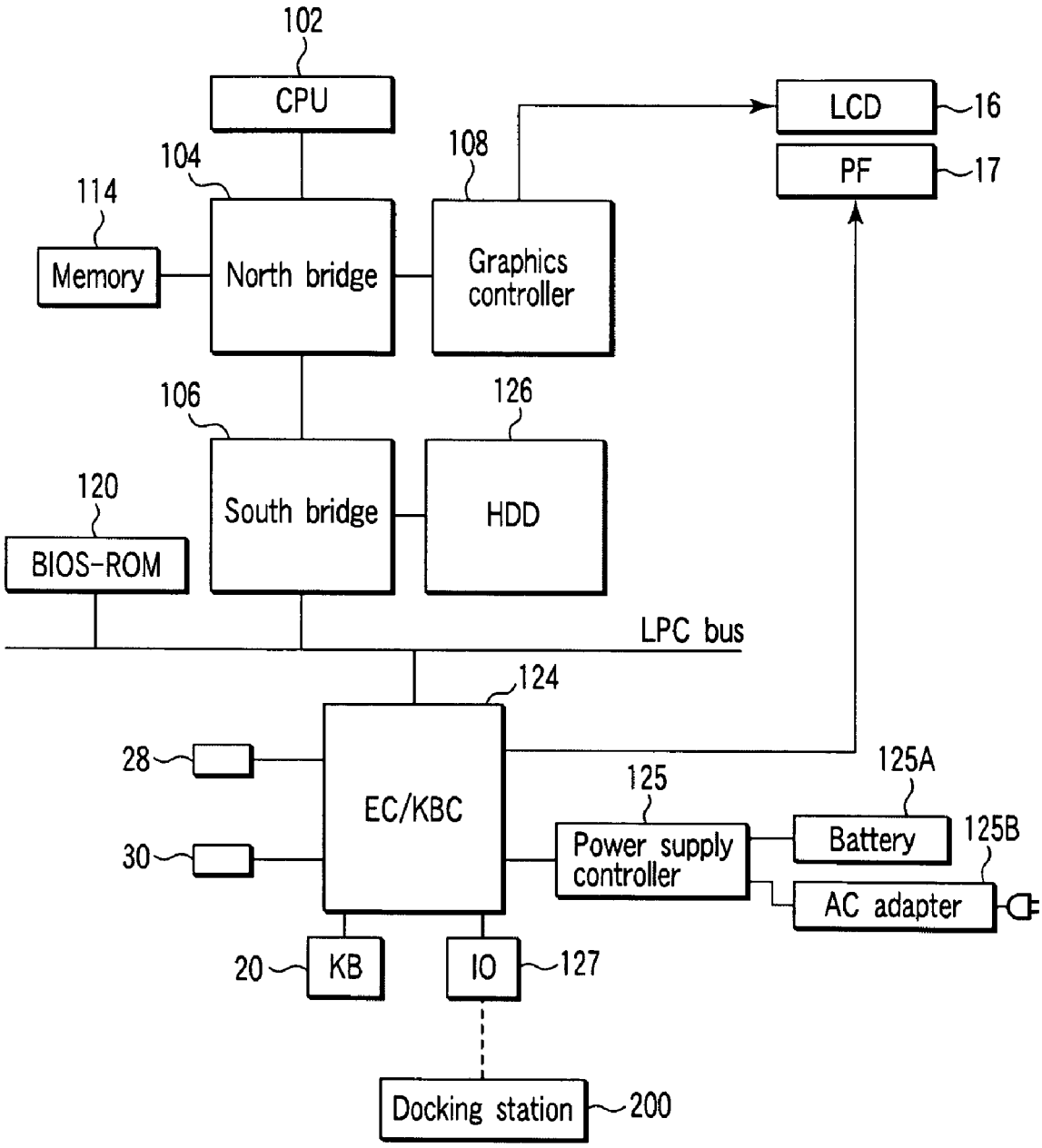
FIG. 5 is an exemplary block diagram showing an example of a circuit configuration of the personal computer regarding the first embodiment of the present invention.

The personal computer 10 includes, as shown in FIG. 5, a CPU 102, a north bridge 104, a main memory 114, a graphics controller 108, a south bridge 106, a basic input output system (BIOS)-ROM 120, a hard disk drive (HDD) 126, an embedded controller/keyboard controller (EC/KBC) IC 124, a power supply controller 125 or the like.

The CPU 102 is a processor disposed in order to control operations of the personal computer 10 and executes an operation system (OS) and a variety of application programs loaded into the main memory 114 from the HDD 126.

The CPU 102 loads a system BIOS stored in the BIOS-ROM 120 then executes it. The system BIOS is a program to control hardware.

The north bridge 104 is a bridge device to connect between a local bus of the CPU 102 and the south bridge 106. A memory controller to control access to the main memory 114 is also incorporated in the north bridge 104. The north bridge 104 also has a function of performing a communication with the graphics controller 108 via an accelerated graphics port (AGP) bus, etc.

The graphics controller 108 is a display controller to control the LCD 16 used as a display monitor of the personal computer 10. The graphics controller 108 has a video memory (VRAM) and generates a video signal to form a display image to be displayed on the LCD 16 from display data drawn in the VRAM by an OS/application program. The video signal generated by the graphics controller 108 is output to a line.

The EC/KBC IC (filter control unit) 124 controls the touch pad 22, scroll button 24, and touch pad control button 26 and also functions as a controller to control the driving of the privacy filter 17. According to one embodiment of the invention, the EC/KBC IC 124 is a one-chip microcomputer to monitor and control a variety of devices (peripheral device, sensor, power supply circuit, etc.) regardless of a system state of the personal computer 10.

If an external power is supplied via the AC adapter 125B, the power supply controller 125 generates system power to be supplied to each component of the personal computer 10 by using the external power supplied from the AC adapter 125B. And if the external power is not supplied via the AC adapter 125B, the power supply controller 125 generates the system power to be supplied to each component (main body 12 and display unit 14) of the personal computer 10 by using the battery 125A. Hereinafter, the case where the driving power of the main body 12 and display unit 14 is the battery 125A is referred to as battery driving (mobile mode).

Figure 6:
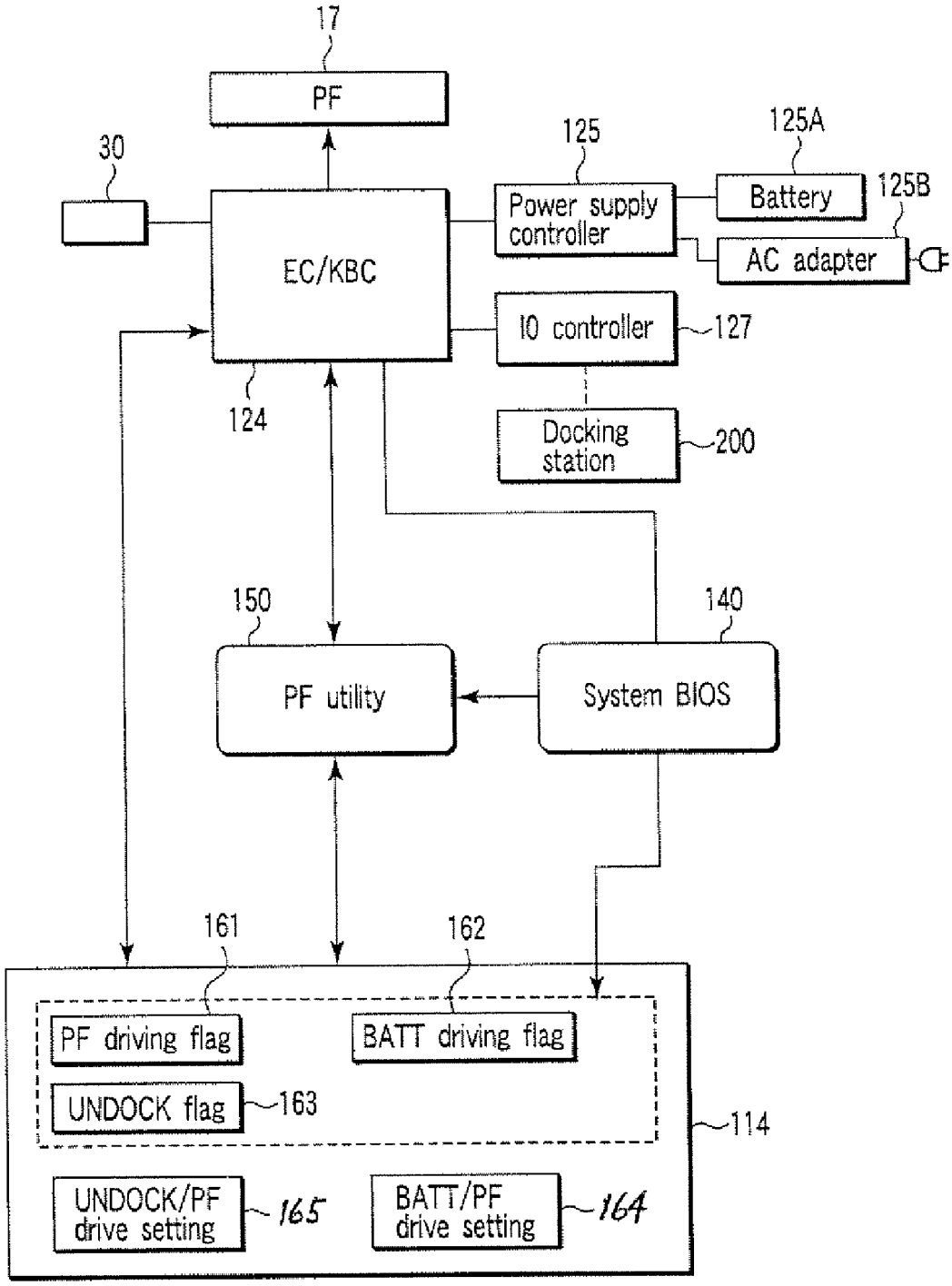
FIG. 6 is an exemplary block diagram showing a configuration for automatically driving the privacy filter in battery driving and in an undocking state.

A configuration to control the driving of the privacy filter 17 will be described by referring to FIG. 6.

Operations of the privacy filter button 30 by a user makes the EC/KBC IC 124 switch on/off a drive signal to the privacy filter 17. The EC/KBC IC 124 provides a driving state of the privacy filter 17 to the system BIOS 140. The system BIOS 140 enables (drives) or disables (does not drive) a privacy filter driving flag (PF driving flag) 161 on the main memory 114 in accordance with the driving state of the privacy filter 17. If the privacy filter 17 is enabled by operating the privacy filter button 30, block figures as shown in FIG. 3A appear on the screen so that recognition of displayed images on the screen from an obliquely lateral direction is difficult.

The power supply controller 125 notifies the EC/KBC IC 124 when a generation source of the system power has changed. The EC/KBC IC 124 notifies system BIOS 140 of the change in the generation source of the system power. The system BIOS 140 enables (battery driving) or disables (external power driving) a BATT driving flag 162 on the main memory 114 in response to the current generation source of the system power.

An IO controller 127 issues an interrupt signal to EC/KBC 124 if the personal computer 10 becomes undocked from the docking station 200 or docks to the docking station 200. The EC/KBC IC 124 provides the docking state of the docking station 200 to a system BIOS 140. The system BIOS 140 enables (undocking state, mobile mode) or disables (docking state) an UNDOCK flag 163 on the main memory 114 in response to the current docking state.

Figure 7:
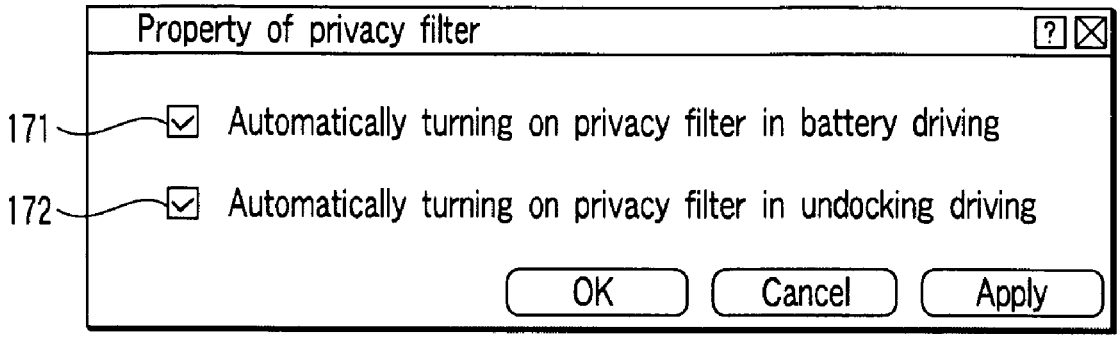
FIG. 7 is an exemplary view showing a setting screen for automatically driving the privacy filter in the battery driving and the undocking state.

A PF utility 150 has a function of setting whether the privacy filter 17 is automatically driven or not driven by the battery when the computer 10 is placed in either the mobile mode or in the undocking mode and coupled to the docking station 200. The PF utility 150 displays a window shown in FIG. 7 on the LCD 16. The privacy filter 17 can be automatically driven when the computer is in mobile mode (battery driving) by putting a check mark into a check box 171. The setting whether the privacy filter 17 should be automatically driven or not is registered in a BATT/PF drive setting 164 on the main memory 114 and is also stored in a BIOS-ROM 120. According to one embodiment of the invention, the PF utility 150 drives the privacy filter 17 automatically when the BATT/PF drive setting 164 is enabled and does not drive it automatically when the BATT/PF drive setting 164 is disabled.

The PF utility 150 can automatically drive the privacy filter 17 when the personal computer 10 is in an undocking state by putting the check mark into a check box 172. The setting whether the privacy filter should be driven or not is registered in an UNDOCK/PF drive setting 165 on the main memory 114 and also stored in the BIOS-ROM 120. The PF utility 150 automatically drives the privacy filter 17 when the UNDOCK/PF drive setting 165 is enabled and does not automatically drive the privacy filter 17 when the UNDOCK/PF drive setting 165 is disabled.

Figure 8:
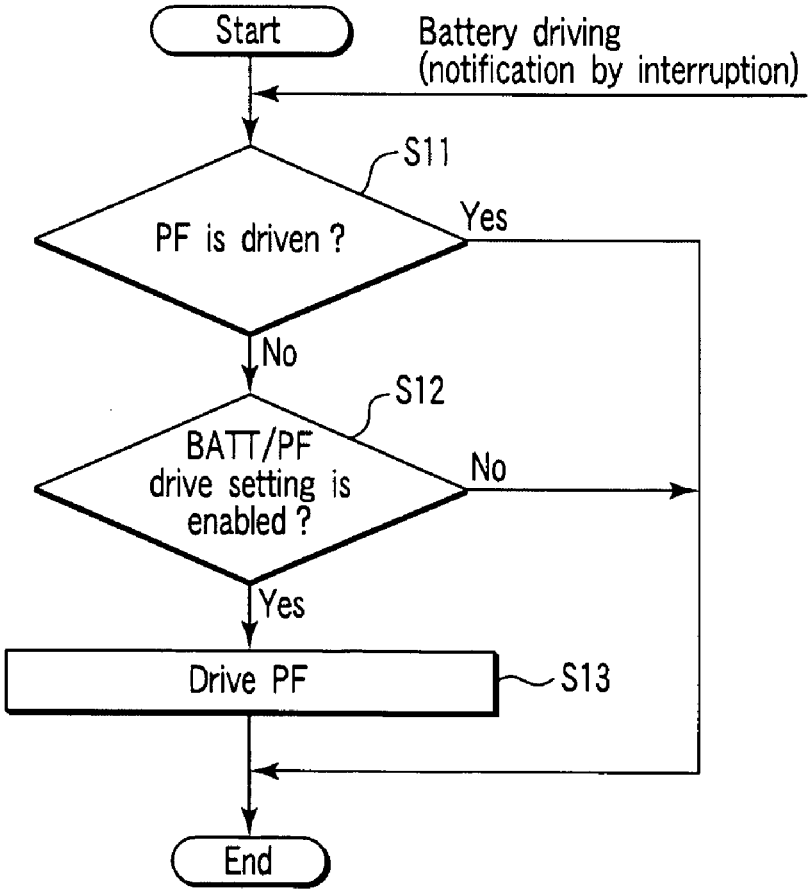
FIG. 8 is an exemplary flowchart showing a procedure of processing to automatically drive the privacy filter when external power driving is switched to battery driving.

Further, a procedure of processing capable of automatically driving the privacy filter 17 in the case of switching from the external power driving to the battery driving will be described with reference to the flowchart in FIG. 8.

The power supply controller 125 interrupts the EC/KBC IC 124 when the personal computer 10 is in the battery driving mode upon switching from the state of generation of the system power by using the external power to the state of generation of the system power by using the battery. The EC/KBC IC 124 refers the PF driving flag 161 of FIG. 6 to determine whether the privacy filter 17 is driven or not (block S11). If the PF driving flag 161 is enabled and the privacy filter 17 is driven (Yes, in block S11), the EC/KBC IC 124 terminates this processing to keep the privacy filter 17 in the driving state.

If the PF driving flag 161 is disabled and the privacy filter 17 is not driven (No, in block S11). The EC/KBC IC 124 refers to the BATT/PF drive setting 164 of FIG. 6 to determine whether the setting to automatically drive the privacy filter 17 is enabled or not in battery driving (mobile mode) (block S12). If the BATT/PF drive setting 164 is disabled (No, in block S12), the EC/KBC IC 124 terminates this processing without driving the privacy filter 17.

If the BATT/PF drive setting 164 is enabled (Yes, in block S12), the EC/KBC IC 124 drives the privacy filter 17 to display a blocking pattern in the case of being viewed from an oblique direction (block S13).

According to the processing described above, when the power supply is switched from the external power driving to the battery driving, the privacy filter 17 can be automatically driven to prevent other persons from viewing contents displayed on the LCD 16.

When the power supply is switched back from the battery driving to the external power driving, the privacy filter 17 can be automatically driven in accordance with the previous PF driving flag 161 at the time just before switching from the external power driving to the battery driving.

Figure 9:
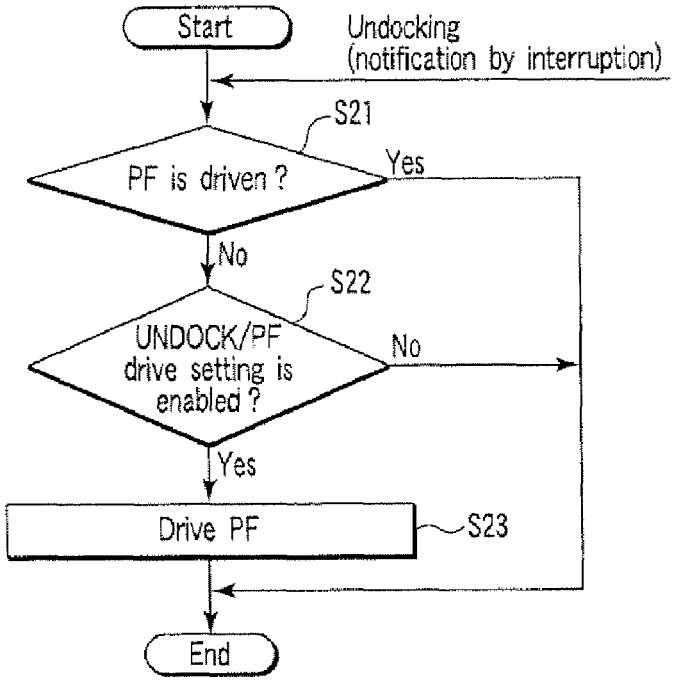
FIG. 9 is an exemplary flowchart showing a procedure of processing to automatically drive the privacy filter when a docking state is switched to an undocking state.

The personal computer 10 can automatically drive the privacy filter 17 when the dock station 200 is undocked. Hereinafter, the procedure of processing to automatically drive the privacy filter 17 in the case of undocking of the docking station 200 will be explained by referring to the flowchart in FIG. 9.

When a change from a state where an IO controller 127 is mounted on the docking station 200 to a state where it is not mounted thereon the IO controller 127 notifies by interruption to the EC/KBC IC 124 the fact that the docking station 200 has been brought into an undocking state. The EC/KBC IC 124 refers the PF driving flag 161 to determine whether the privacy filter 17 is in the driving state or not (block S21). If the PF driving flag 161 is enabled and the privacy filter 17 is driven (Yes, in block S21), the EC/KBC IC 124 terminates this processing so as to keep the privacy filter 17 in the driving state.

When the PF driving flag 161 is disabled and the privacy filter 17 is not driven (No, in block S21), the EC/KBC IC 124 refers the UNDOCK/PF drive setting 165 to determine whether the setting to automatically drive the privacy filter 17 in undocking is enabled or not (block S22). When the privacy filter 17 in undocking is disabled (No in block S22), the EC/KBC IC 124 terminates this processing without driving the privacy filter 17.

When the privacy filter 17 in undocking is enabled, the EC/KBC IC 124 drives the privacy filter 17 (block S23).

According to the processing mentioned above, it becomes possible to automatically drive the privacy filter 17 when the personal computer 10 is removed from the docking station 200 and to prevent the contents displayed on the LCD 16 from being viewed by other persons.

When the personal computer 10 is reconnected to the docking station 200, the privacy filter 17 can be automatically driven in accordance with the previous PF driving flag 161 at the time just before removing from the docking station 200.

Figure 10:
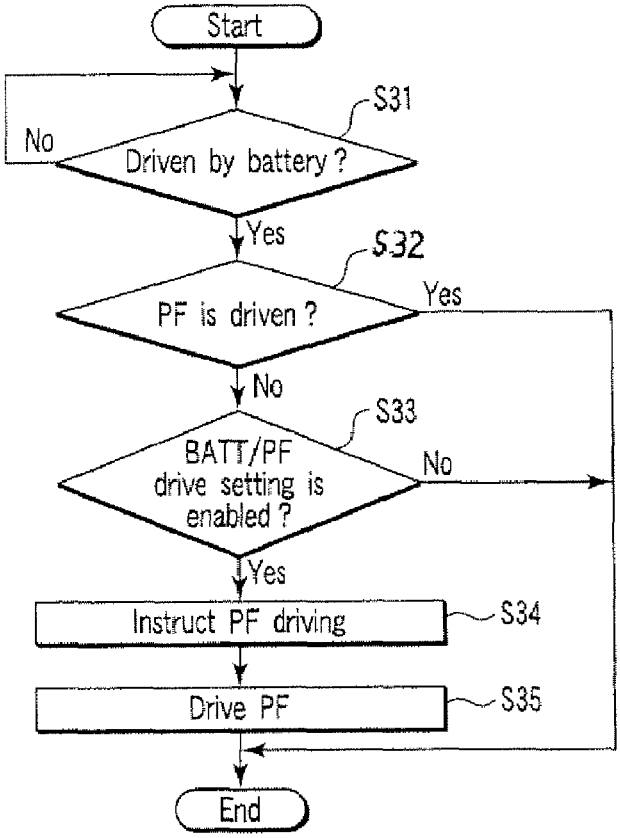
FIG. 10 is an exemplary flowchart showing a procedure of processing to automatically drive the privacy filter in the battery driving.
Figure 11:
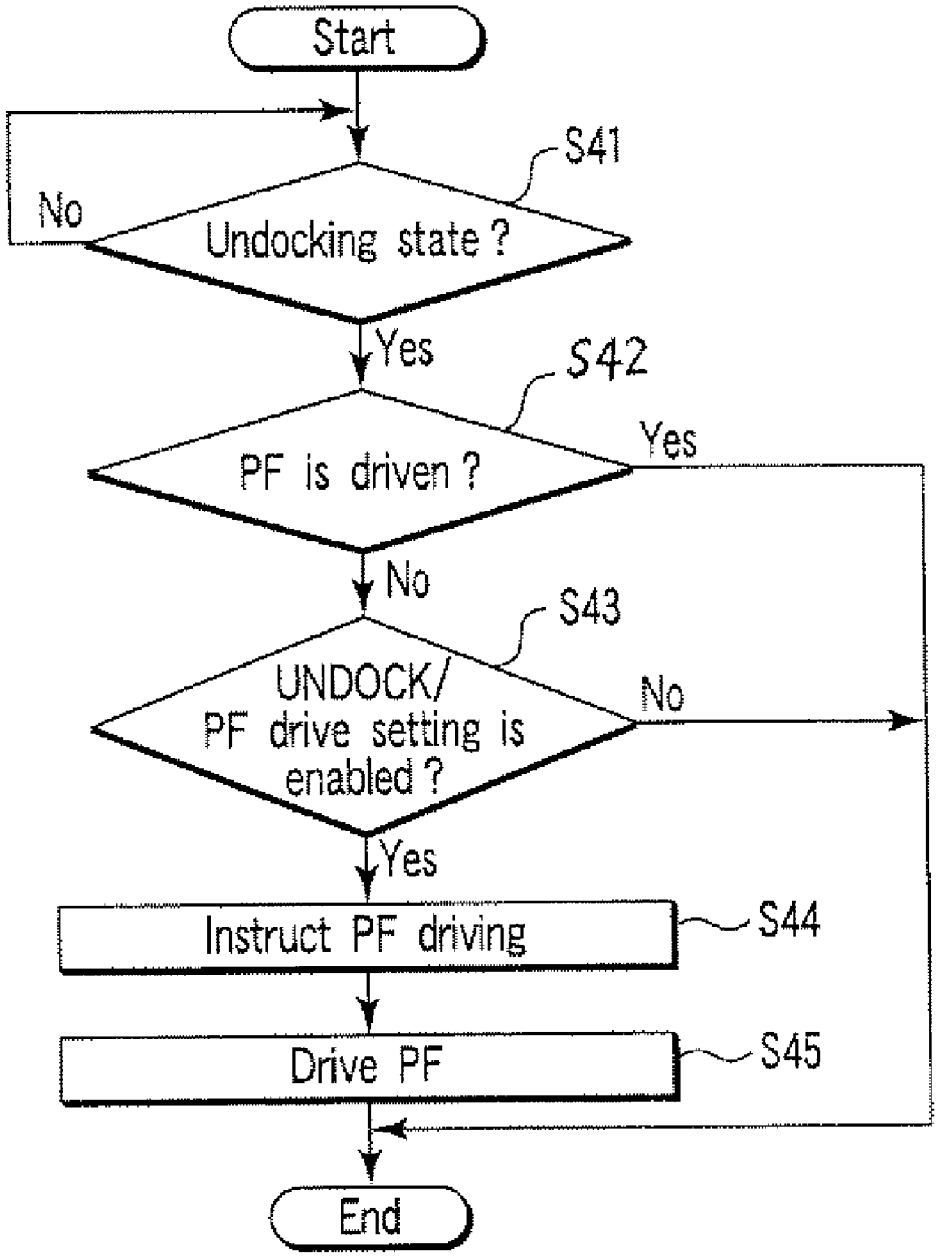
FIG. 11 is an exemplary flowchart showing a procedure of processing to automatically drive the privacy filter in the undocking state.

Next, the procedure of the processing in which the PF utility 150 determines whether or not the personal computer 10 is in the battery driving state with specified timing and can automatically drive the privacy filter 17 in battery driving will be explained as follows by referring to the flowchart in FIG. 10.

When the generation source of the system power is changed, the power supply controller 125 notifies by interruption the generation source of the system power to the EC/KBC IC 124. When the generation source is changed, the EC/KBC IC 124 notifies the generation source to the system BIOS 140. Further, when the generation source of the system power is changed, the system BIOS 140 writes generation source information of the system power into the BATT driving flag 162 in the BIOS-ROM 120 and also notifies the generation source to the operation system. When the BATT driving flag 162 is enabled, the PF utility 150 generates the system power by using the battery, and when the BATT driving flag is disabled, the PF utility 150 generates the system power by using the external power. The operating system manages power in response to the notified generation source of the system power.

The PF utility 150 accesses the BATT driving flag 162 at every specified timing in order to determine whether or not the personal computer 10 is driven by the battery 125A (block S31). If the BATT driving flag 162 is enabled and the system power is generated with the use of the battery 125A (Yes, in block S31), the PF utility 150 refers the PF driving flag 161 to determine whether or not the privacy filter 17 is driven (block S32).

When the privacy filter 17 is driven (Yes, in block S32), the PF utility 150 terminates the processing so as to keep the privacy filter 17 in the driving state.

When the privacy filter 17 is not driven (No, in block S32), the PF utility 150 refers the BATT/PF drive setting 164 to determine whether or not the privacy filter 17 is set to be automatically driven in battery driving (block S33) If the BATT/PF drive setting 164 is in disabled state, the privacy filter 17 is not driven and the processing is terminated (No, in block S33).

If the BATT/PF drive setting 164 is in enabled state, (Yes, in block S33), the PF utility 150 instructs the EC/KBC IC 124 so as to drive the privacy filter 17 (block S34). The EC/KBC IC 124 drives the privacy filter 17 to display the blocking pattern for the viewing from the oblique direction (block S35).

In the processing described above, when the external power supply driving is switched to the battery driving, it becomes possible to automatically drive the privacy filter 17 to prevent the contents displayed on the LCD 16 from being viewed by other persons.

Next to this, hereinafter, the procedure of the processing in which the PF utility 150 determines whether or not the personal computer 10 is in the undocking state at the specified timing and can automatically drive the privacy filter 17 in the undocking state will be described.

When detecting the change from the state of being mounted on the docking station 200 to the state of being removed from the docking station 200, the IO controller 127 notifies by interruption to the EC/KBC IC 124 the fact that the IO controller 127 has been removed from the docking station 200. The EC/KCB IC 124 notifies to the system BIOS 140 the fact of being removed from the docking station 200. The system BIOS 140 writes the information whether or not the IO controller 127 is in the undocking state into an UNDOCK flag 163 in the BIOS-ROM and also notifies the information about the state to the operation system. If the UNDOCK flag 163 is enabled, the IO controller 127 is in the undocking state, and otherwise, the IO controller is mounted on the docking station 200.

The PF utility 150 refers the UNDOCK flag 163 to determine whether or not the IO controller 127 is in the undocking state (block S41). When the UNDOCK flag 163 is disabled and the IO controller 127 is not in the undocking state (No, in block S41), then after a specified time period, the PF utility 150 refers the UNDOCK flag 163 to determine whether the IO controller 127 is in the undocking state or not (block S41).

When the UNDOCK flag 163 is enabled and the IO controller 127 is in the undocking state (Yes, in block S41), the PF utility 150 refers the PF driving flag 161 to determine whether or not the privacy filter 17 is in the driving state (block S42). When the privacy filter 17 is driven (Yes, in block S42), the PF utility 150 terminates the processing in order to leave the privacy filter 17 in the driving state.

When the privacy filter 17 is not driven (no, in block S42), the PF utility 150 refers the UNDOCK/PF drive setting 165 to determine whether or not the setting to automatically drive the privacy filter 17 in the undocking state is enabled (block S43). If the setting to automatically drive the privacy filter 17 in the undocking state is disabled (No, in block s43), the PF utility 150 terminates the processing without driving the privacy filter 17.

Otherwise (Yes, in block S43), the PF utility 150 instructs to the ECB/KBC IC 124 so as to drive the privacy filter 17 (block S44). The EC/KBC IC 124 drives the privacy filter 17 to display the blocking pattern in the case where the screen is viewed from the obliquely front direction (block S45).

According to the aforementioned processing, when the personal computer 10 is removed from the docking station 200, the user can automatically drive the privacy filter 17 and does not allow other persons to peep into the contents to be displayed on the LCD 16.

As mentioned above, if the personal computer 10 is not connected to the AC adapter 125B or the docking station 200 and if in the mobile mode possible to carry the personal computer 10, the user can drives the privacy filter 17 to enhance confidentiality of the contents displayed on the LCD 16.

The invention is not limited to the specific details and representative embodiments shown and described herein, and in an implementation phase, various types of modifications may be made without departing from the spirit or scope of the general inventive concept of the invention. Various types of the invention can be formed by appropriately combining a plurality of constituent elements disclosed in the foregoing embodiments. Some of the elements, for example, may be omitted from the whole of the constituent elements shown in the embodiments mentioned above. The constituent elements over different embodiments further may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. Adapted for coupling to a docking station, an information processing device operating in one of a plurality of modes including a first mode and a second mode, comprising:

a body;

a display unit supported by the body and including a display panel;

a viewing angle control filter disposed at the display unit and arranged facing one face of the display panel; and means for driving the viewing angle control filter when a state of the information processing device is in the second mode, wherein the second mode is a state in which the body becomes disconnected from an expansion unit.

2. The information processing device according to claim 1 further comprising a memory device to store data that operates as a setting to indicate to the means for driving whether or not the viewing angle control filter is driven.

3. The information processing device according to claim 2 being placed in the second mode automatically by the means for driving the viewing angle control filter when the body becomes disconnected from the expansion unit.

4. The information processing device according to claim 3, wherein the means for driving drives the viewing angle control filter in accordance with the setting irrespective of a status of the switch.

5. The information processing device according to claim 1, wherein the means for driving drives the viewing angle control filter also operates in the second mode when an alternating current (AC) adapter is disconnected from the body.

6. The information processing device according to claim 1, wherein the expansion unit is a docking station.

7. An information processing device, comprising:

a body adapted to receive a battery and for coupling to an expansion unit;

a display unit coupled to the body, the display unit including a display panel and a viewing angle control filter; and a controller configured to automatically drive the viewing angle control filter when driving power of the body and the display unit is the battery and the body is decoupled from the expansion unit.

8. The information processing device according to claim 7 further comprising a power supply controller in communication with the controller.

9. The information processing device according to claim 8 further comprising an IO controller in communication with the controller to notify the controller of a docking state of the information processing device, the docking state being loaded into memory.

10. The information processing device according to claim 7 further comprising means for setting viewing angle control filter to be automatically driven when the information processing device is supplied power from the battery.

11. The information processing device according to claim 7, wherein the expansion unit is a docking station.

12. The information processing device according to claim 11 further comprising means for setting whether or not the viewing angle control filter is to be driven when the body is not coupled to the expansion unit.

13. A method for controlling an information processing device being adapted to operate in a first mode and a second mode and including a display panel and a viewing angle control filter disposed facing one face of the display panel, comprising:

determining whether or not the information processing device is operating in the second mode; and driving the viewing angle control filter when the information processing device is operating in the second mode, the second mode being a state in which the information processing device is not connected to an expansion unit.

14. The method according to claim 13, further comprising setting the viewing angle control filter to be driven, wherein the driving of the viewing angle control filter is performed when the viewing angle control filter is set to be driven.

15. The method according to claim 13, further comprising setting the viewing angle control filter to be driven, wherein the driving of the viewing angle control filter is performed when the viewing angle control filter is set to be driven and the driving of the viewing angle control filter is performed irrespective of a current driving status of the viewing angle control filter.

16. The method according to claim 13, wherein the second mode is a state in which an AC power adapter is disconnected from the information processing device.

17. The method according to claim 13, wherein the second mode is a state in which driving power of the body and the display unit is a battery.

18. The method according to claim 13, wherein the expansion unit is a docking station.

* * * * *